US006298484B1

(12) United States Patent
Beckman

(10) Patent No.: US 6,298,484 B1
(45) Date of Patent: Oct. 9, 2001

(54) PROTECTIVE GUARD

(76) Inventor: David Edward Beckman, 300 S. St. James Blvd., Evansville, IN (US) 47714

( * ) Notice: Subject to any disclaimer, the term of this patent is extended or adjusted under 35 U.S.C. 154(b) by 16 days.

(21) Appl. No.: 09/742,912

(22) Filed: Dec. 20, 2000

Related U.S. Application Data

(60) Provisional application No. 60/173,033, filed on Dec. 23, 1999.

(51) Int. Cl.[7] ..... A41D 13/00

(52) U.S. Cl. ..... 2/22; 2/911; 602/62

(58) Field of Search ..... 2/22, 24, 23, 455, 2/16, 911, 242, 239; 36/1.5, 2 R; 602/23, 27, 62, 65

(56) References Cited

U.S. PATENT DOCUMENTS 2,544,065 * 3/1951 Carr ..... 2/22
4,001,953 * 1/1977 Fugere et al. ..... 36/2 R
4,306,315 * 12/1981 Castiglia ..... 2/22
4,669,126 * 6/1987 Jones ..... 2/22
5,297,294 * 3/1994 Washick ..... 2/22
5,301,370 * 4/1994 Henson ..... 2/22
5,491,840 * 2/1996 Yen ..... 2/455
5,581,817 * 12/1996 Hicks ..... 2/239
5,732,411 * 3/1998 Coleman et al. ..... 2/22
5,829,055 * 11/1998 Collin et al. ..... 2/22

* cited by examiner

*Primary Examiner*—John J. Calvert
*Assistant Examiner*—Tejash Patel
(74) *Attorney, Agent, or Firm*—Gary K. Price

(57) ABSTRACT

A protective guard particularly intended for soccer players in which the participant wears the protective guard below the wearer's knees to protect the wearer's shins, calves, ankles and Achilles tendon from possible impact.

3 Claims, 4 Drawing Sheets

PROTECTIVE GUARD

CROSS REFERENCES TO RELATED APPLICATIONS

U.S. Provisional Application for Patent 60/173,033, filed Dec. 23, 1999, with title, "Protective Guard" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention pertains to a protective guard particularly intended for soccer players in which the participant wears the protective guard below the wearer's knees to protect from injury.

2. Background Information

In sports such as soccer, where much of the physical impact takes place below the participant's knees, it is desirable to protect a player's shins, calves, ankles and Achilles tendon from possible impacts.

With the growing number of adults and children participating in athletic contests such as soccer, it has become increasingly significant that injuries be prevented and/or at least minimized as possible. Soccer players are frequently struck along the shin and calf areas of their legs during play. Plastic or metal shin guards have been in use for many years to specifically protect the player's shins, ankles and Achilles tendon area during the athletic contest. It is known from U.S. Pat. No. 5,301,370 to provide a shin pad with ankle bone and Achilles tendon protection. U.S. Pat. Nos. 4,669,126 and 5,581,817 each provide an athletic sock which incorporates a pad to protect the wearer's shin area. U.S. Pat. No. 5,829,055 is directed to a shin and knee guard.

The inventor is unaware of prior art that provides a protective guard which will protect the wearer's shin, ankle and Achilles tendon areas, and the calf area, while being both easy to use and relatively inexpensive to fabricate.

As will be seen from the subsequent description, the preferred embodiments of the present invention overcome the current limitations of the prior art.

SUMMARY OF THE INVENTION

The present invention provides an ankle sock having a shin guard and a calf guard. The ankle sock is provided having a stirrup strap, and includes a protective padding to protect the participant's ankles and Achilles tendon.

BRIEF DESCRIPTION OF THE PREFERRED EMBODIMENT

Figure 1:
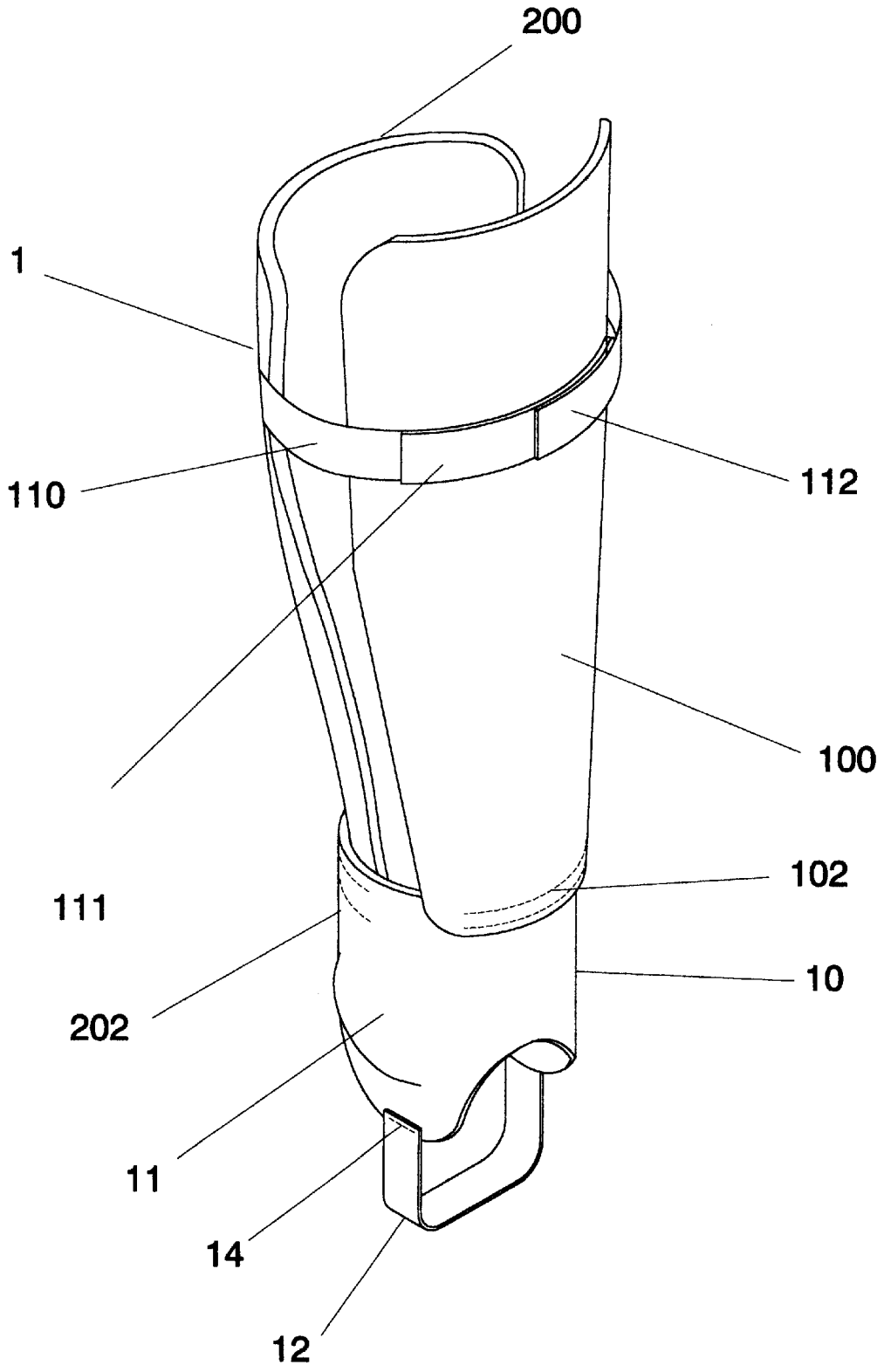
FIG. 1 is the preferred embodiment of the present invention, a protective guard.

In FIG. 1 there is shown a protective guard 1 in accordance with the present invention.

The protective guard 1 comprises a shin guard 100, a calf guard 200, an ankle sock 10 having an ankle protection padding 11, an Achilles tendon protection pad 15 (shown in FIG. 2), and a stirrup strap 12.

Figure 2:
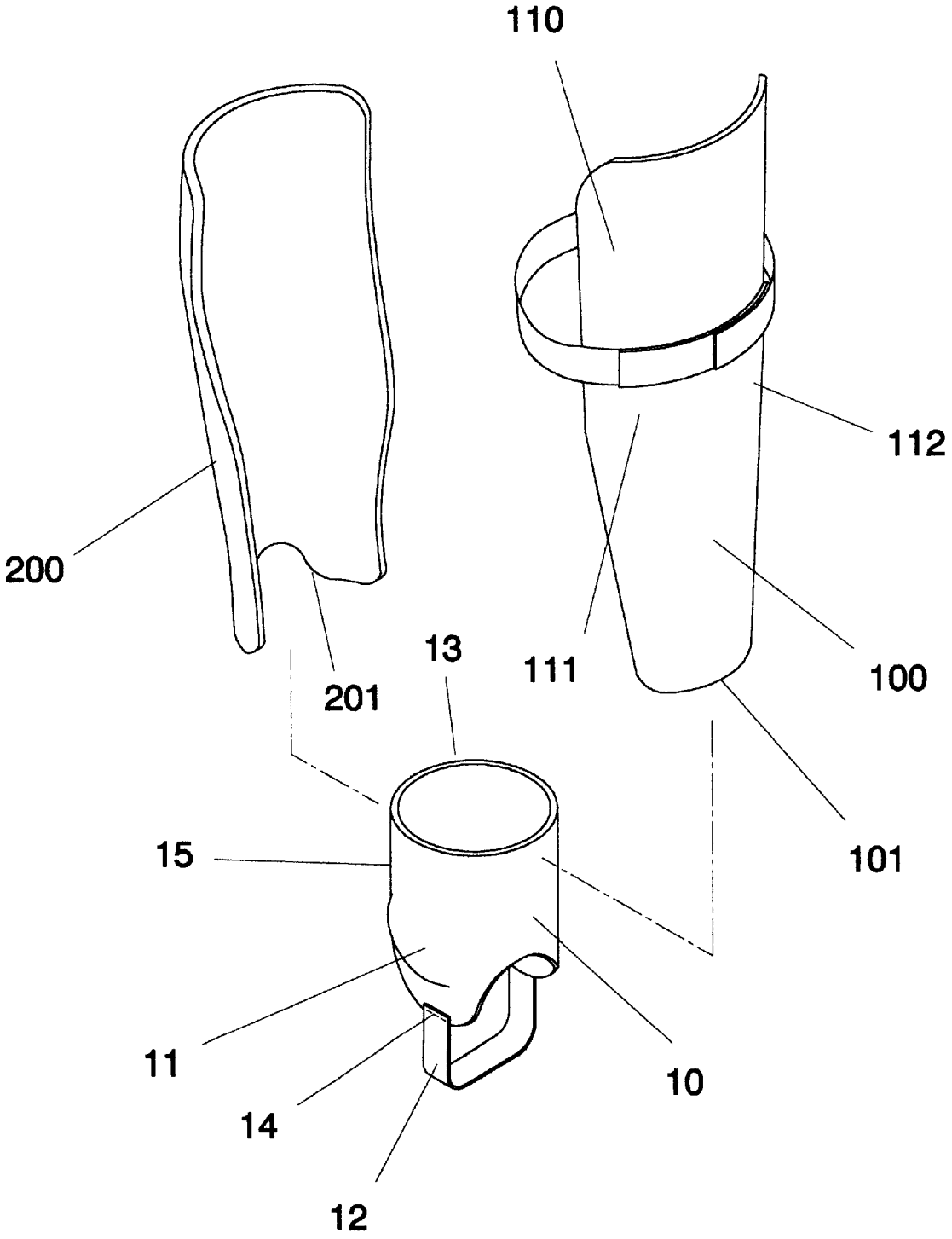
FIG. 2 illustrates components of the protective guard, namely the shin guard, calf guard, ankle sock with stirrup strap.

In general, referring to FIG. 2, lower shin section 101 of shin guard 100 and a lower calf section 201 of calf guard 200 are bonded to opposite sides of a top end 13 of the ankle sock 10. The shin guard 100 which covers the wearer's shin area is connected to the calf guard 200 which covers the wearer's calf area, and fitted proportionately to the participant's lower leg via a releasable fastening means comprising of a flexible fastening strap 110, loops 111 and hooks 112 such as VELCRO, that interconnect the shin guard 100 and calf guard 200 in opposed relationship when unreleased. The flexible fastening strap 110, loops 111 and hooks 112 enable the shin guard 100 and calf guard 200 to be maintained in proper position against urging forces. The use of VELCRO allows simple, quick and easy adjustment of the location tension of the flexible fastening strap 110. The stirrup strap 12 is an elastic strap secured to and extending from the bottom end of the ankle sock 10 at the seam designated 14 in FIG. 1. The stirrup 12 further secures the shin guard 100, calf guard 200, and ankle sock 10 in position while the protective guard 1 is being worn.

Figure 3:
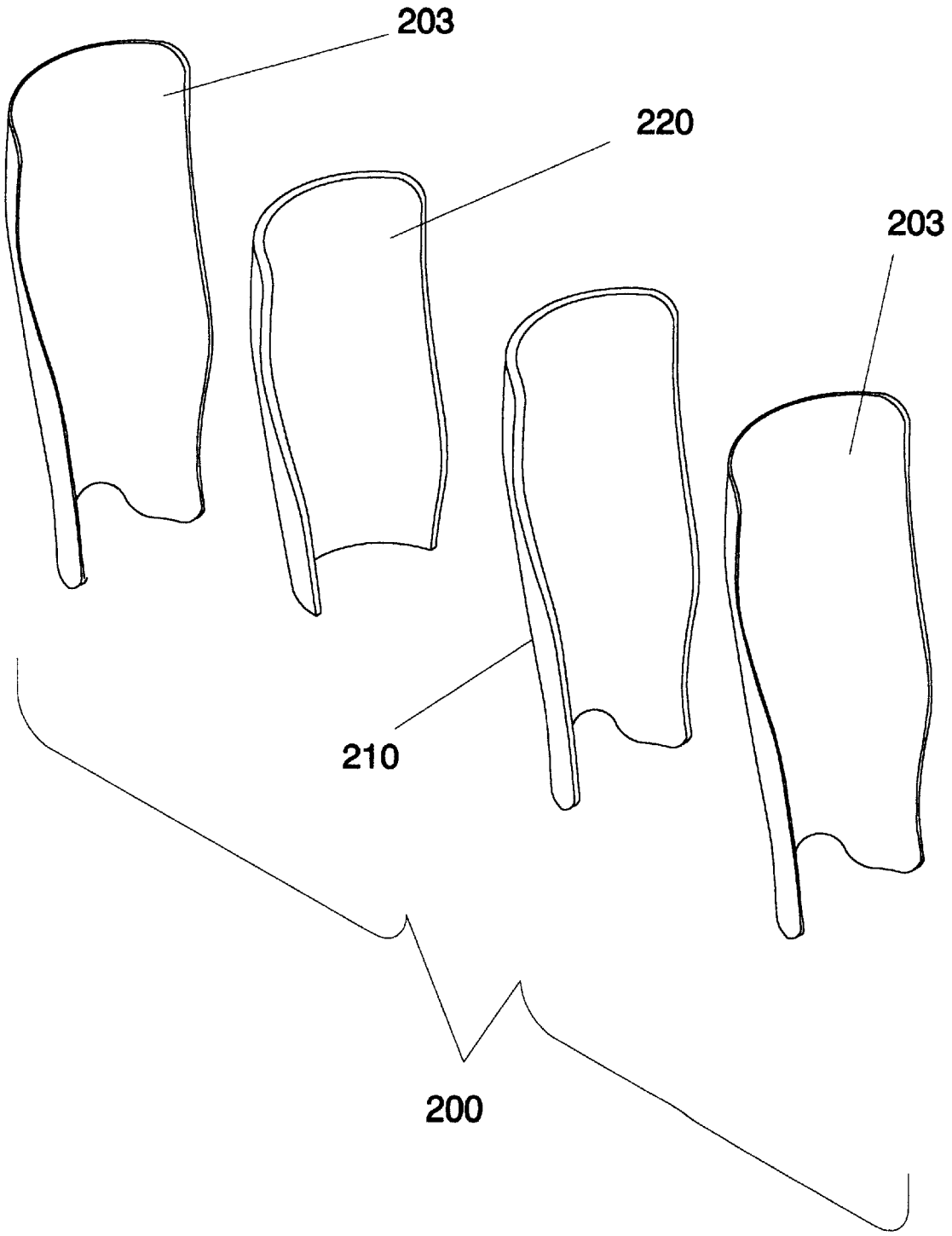
FIG. 3 is a side view showing the various components of the calf guard.
Figure 4:
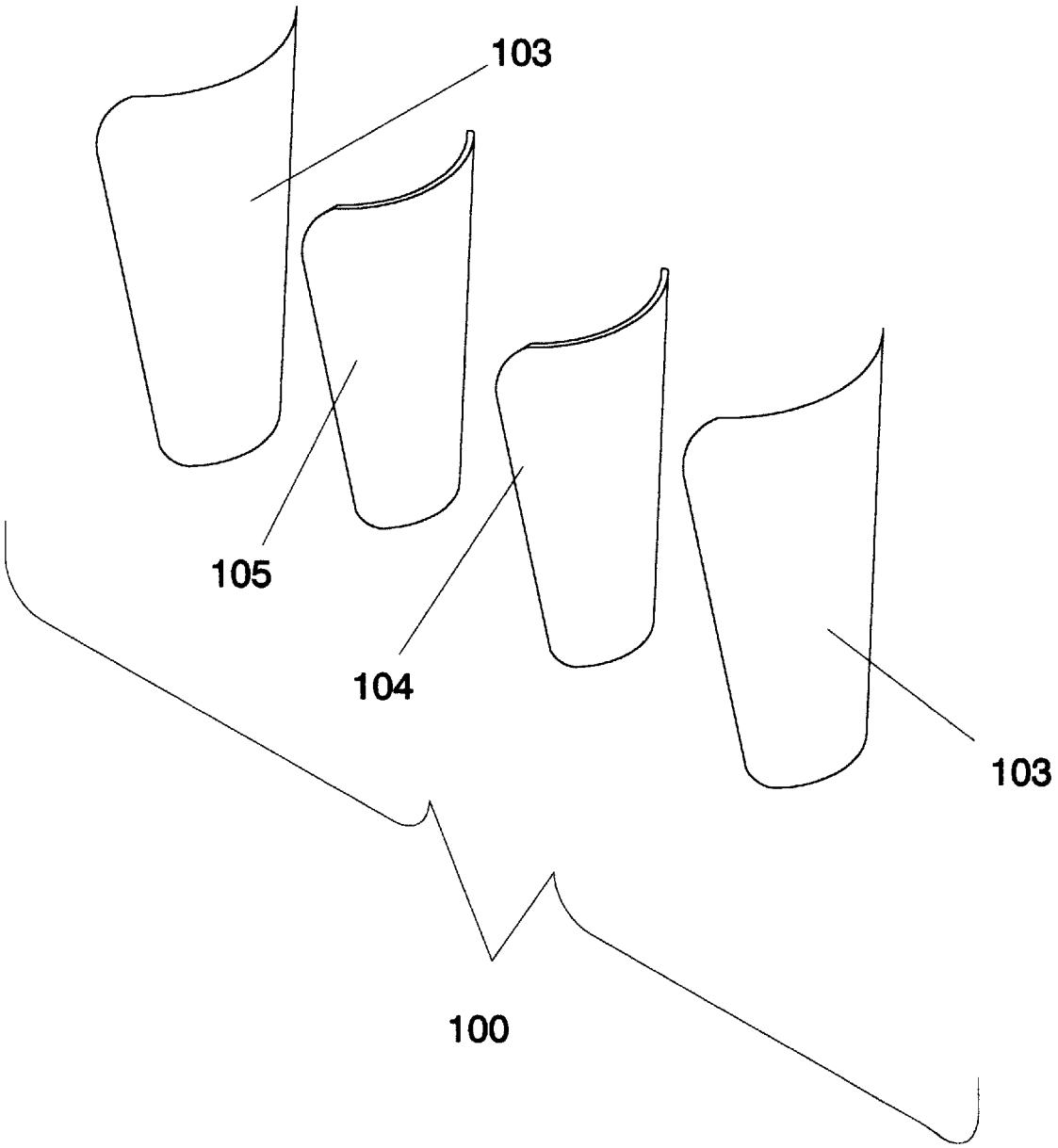
FIG. 4 is a side view showing the various components of the shin guard.

Referring to FIG. 3, the calf guard 200 is formed from two layers of a material for calf section 203 between which is located a first calf pad 220 and a second calf pad 210. As shown in FIG. 3, the calf guard 200 is secured to the inside of the ankle sock 10 at the seam designated 202 in FIG. 1; however, it would be obvious to one skilled in the art that the calf guard 200 may be secured to the outside of the ankle sock 10 at said seam 202. Further, while FIG. 3 shows the calf guard 200 formed from said two layers of material 203 and pads 210 and 220, it is obvious that at least one layer of material 203 and at least one padding protection may be used. The shin guard 100, as shown in FIG. 4, is formed from two layers of a material for shin section 103 between which is located a first shin pad 105 and a second shin pad 104. As shown in FIG. 4, the shin guard 100 is secured to the outside of the ankle sock 10 at the seam designated 102 in FIG. 1; however, it would be obvious to one skilled in the art that the shin guard 100 may be secured to the inside ankle sock 10 at said seam 102. Further, while FIG. 4 shows the shin guard 100 formed from two layers of material 103 and pads 104 and 105, it is obvious that at least one layer of material 103 and at least one padding protection may be used. In the preferred embodiment, the securing is accomplished by sewing or bonding.

The ankle sock 10 is formed from two layers of elastic material (not shown) between which is located the ankle protection padding 11 and the Achilles tendon protection pad 15. The ankle protection padding 11 and the Achilles tendon protection pad 15 takes the form of domed shape protectors which cover the points of the wearer's ankle bone and Achilles tendon in use. With the calf guard 200, shin guard 100, ankle protection padding 11, and Achilles tendon protection pad 15 connected in the fashion above described, direct impact pressure to the protective guard 1 is distributed and not directly transmitted through the padding.

The first calf pad 220, the first shin pad 105, the ankle protection padding 11, and Achilles tendon protection pad 15 are preferably formed from foam molded plastics. Ad The material for calf section 203 and the material for shin section 103 is generally made At of a relatively tough, stiff fabric; however it may be preferable for the innermost layer of the material for calf section 203 and the innermost layer of the material for shin section 103 which contacts the body of the wearer when in use, be a softer material. The second calf pad 210 and the second shin pad 104 are less rigid material than that used for the first calf and shin pad 220 and 105, so to absorb urging forces.

Calf guard 200 is substantially identical in shape to shin guard 100. The exact shape may be varied so long as adequate protection to the shin and calf areas is accomplished. The calf guard 200, will, however, have slightly smaller dimensions than the shin guard 100.

Although the description above contains many specificities, these should not be construed as limiting the scope of the invention but as merely providing illustrations of some of the presently preferred embodiments of this invention. For example, while the invention is discussed in terms of a protective guard for soccer, it is very applicable to other contact sports such as field hockey, rugby, basketball, football and baseball. Further, the illustrations and examples provided herein are for explanatory purposes as those skilled in the art can vary the exact construction, sizes, and production techniques. Thus the scope of the invention should be determined by the appended claims in the formal application and their legal equivalence, rather than by the examples given.

I claim:

1. A protective guard comprising an ankle sock, a shin guard, a calf guard, and a stirrup strap, said ankle sock having a top end and a bottom end, wherein the shin guard and the calf guard are bonded to opposite sides of the top end of the ankle sock.

2. A protective guard particularly intended for sports participants in which the participant wears the protective guard below the participant's knees to protect the participant's shins, calves, ankles and Achilles tendon from injury, comprising an ankle sock, a shin guard, a calf guard, and a stirrup strap, wherein the calf guard is formed from two layers of material between which is located a first calf pad and a second calf pad.

3. The protective guard of claim 2, wherein the shin guard and the calf guard are bonded to opposite sides of the top end of the ankle sock.

* * * * *